US006282796B1

(12) United States Patent
Lin

(10) Patent No.: US 6,282,796 B1
(45) Date of Patent: Sep. 4, 2001

(54) HOLE-PUNCHING PLIERS

(75) Inventor: Kun-Meng Lin, Chuang-hua Hsien (TW)

(73) Assignee: Qualipro Enterprise Co., Ltd., Chuanghua Hsien (TW)

( * ) Notice: Subject to any disclaimer, the term of this patent is extended or adjusted under 35 U.S.C. 154(b) by 0 days.

(21) Appl. No.: 09/497,505

(22) Filed: Feb. 4, 2000

(51) Int. Cl.[7] ..... B26F 1/00
(52) U.S. Cl. ..... 30/364; 30/363
(58) Field of Search ..... 30/358, 360, 363, 30/364

(56) References Cited

U.S. PATENT DOCUMENTS 664,299 * 12/1900 Smith ..... 30/364
734,157 * 7/1903 Bernard ..... 30/364
889,075 * 5/1908 Walter ..... 30/363
898,397 * 9/1908 Whitney ..... 30/363
1,308,272 * 7/1919 Berglund ..... 30/364
4,193,191 * 3/1980 Sisco ..... 30/364
5,101,566 * 4/1992 Crapo et al. ..... 30/363

* cited by examiner

*Primary Examiner*—Hwei-Siu Payer
(74) *Attorney, Agent, or Firm*—Bacon & Thomas, PLLC

(57) ABSTRACT

An improved hole-punching pliers has a holding part and a pressing part that are in pivotal combination with each other by way of a pair of connection plates. The holding part and the pressing part are provided respectively with a dentate engaging section so that they can be partially in mesh with each other in assembly to provide a secondary fulcrum in addition to the connection plates. Thereby when the holding part and the pressing part are held by a pair of connection plates and pressed with force, the mesh of the dentate engaging sections of the holding part and the pressing part can produce a double lever effect, rendering effective transmission of force applied to the holding part and the pressing part to punch a hole on an object.

4 Claims, 8 Drawing Sheets

HOLE-PUNCHING PLIERS

BACKGROUND OF THE INVENTION

1. Field of the Invention

The present invention relates to an improved hole-punching pliers which is equipped with a link arm serving as a pivot center in operation. The hole-punching pliers has a holding part and a pressing part that are in pivotal combination with each other. The holding part and the pressing part are provided respectively with a dentate section so that they can be partially in mesh with each other in assembly. Thereby when the holding part and the pressing part are held by a pair of connection plates and pressed with force, the mesh teeth of the dentate engaging sections of the holding part and the pressing part in mesh with each other helps more effective transmission of force applied to the holding part and the pressing part to punch a hole on an object with ease and no effort at all.

2. The Prior Art

Referring to FIGS. 1, 2, conventionally, a hole-punching pliers has two pivotal parts, a holding part 10 having a holding section 11 at a rear end thereof and a pressing part 20 having a pressing section 21 at a rear end thereof that are pivotally combined together by way of a pin shaft 30 located in mounting holes 13 (22). The holding part 10 also has an open insertion space 12 and the pressing part 20 also has a mounting hole 24. A rotary hole-punching wheel 40 is secured to a front end of the pressing part 20 and an anvil 14 is disposed at a front end of the holding part 20. The rotary hole-punching wheel 40 having a plurality of punching rods 41 which can be rotated for selection of a proper punching rod 41 having a proper diameter is fixed in place by a retaining arm 50 having a retaining end 51 engaged with a fixing hole 23 so that holes of different diameters can be punched when a force is applied to the holding part and the pressing part at the same time. Such a prior art hole-punching pliers is typically designed and must be operated with relative effort.

SUMMARY OF THE INVENTION

Therefore, the primary object of the present invention is to provide an improved hole-punching pliers which has a spring-operated holding part and a pressing part that are pivotally engaged with each other at one end by way of gear-like or dentate sections and a pair of connection plates whereby an effective double lever result can be generated at the hole-punching wheel and an anvil spot in a ratio of 1:1.5 when a small force is applied to the holding section and the pressing section of the hole-punching pliers. So, only a half amount of force is used to effect a hole-punching task.

DETAILED DESCRIPTION OF THE PREFERRED EMBODIMENTS

Figure 1:
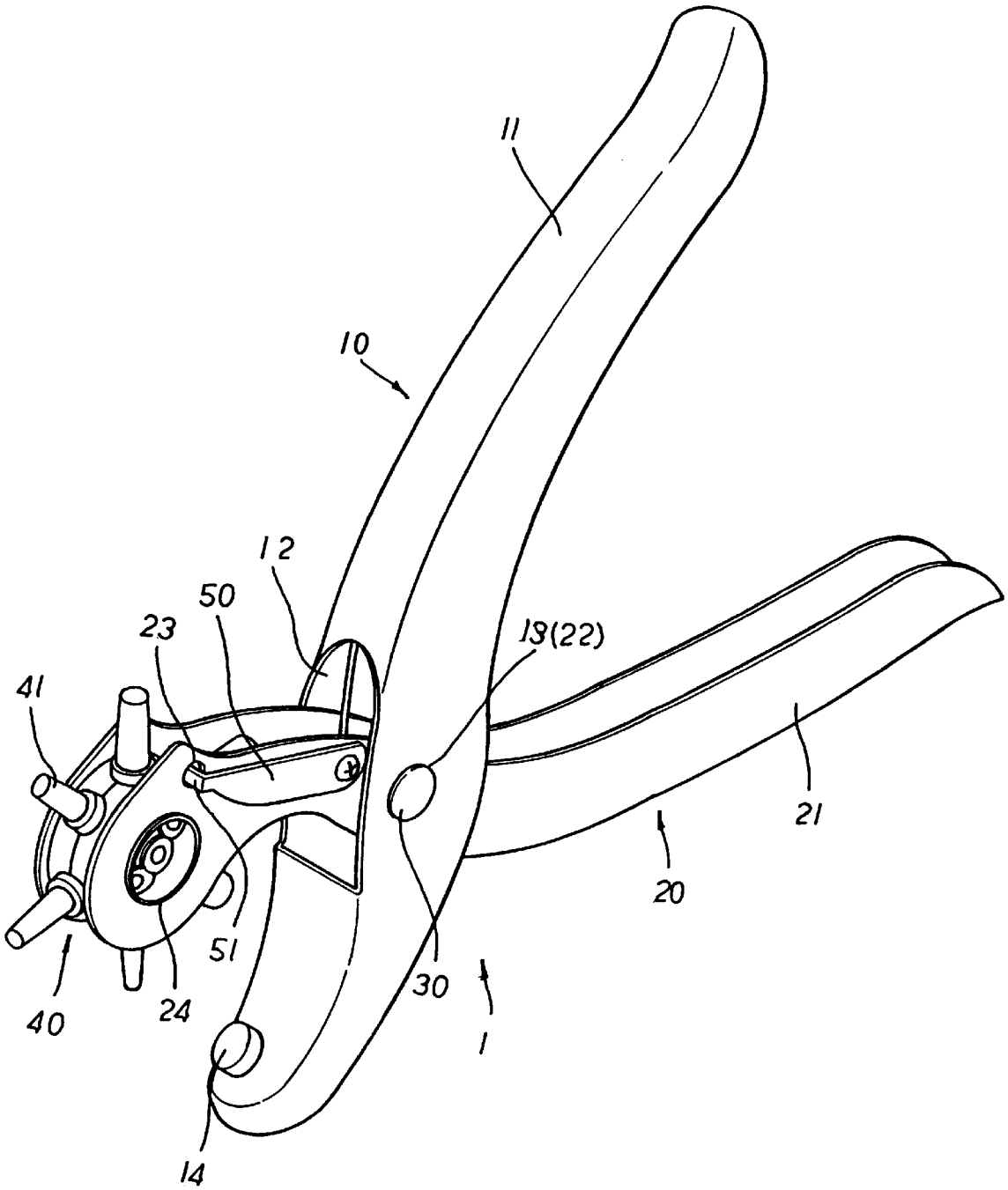
FIG.1 PRIOR ART
FIG. 1 is a prior art hole-punching pliers.
Figure 2:
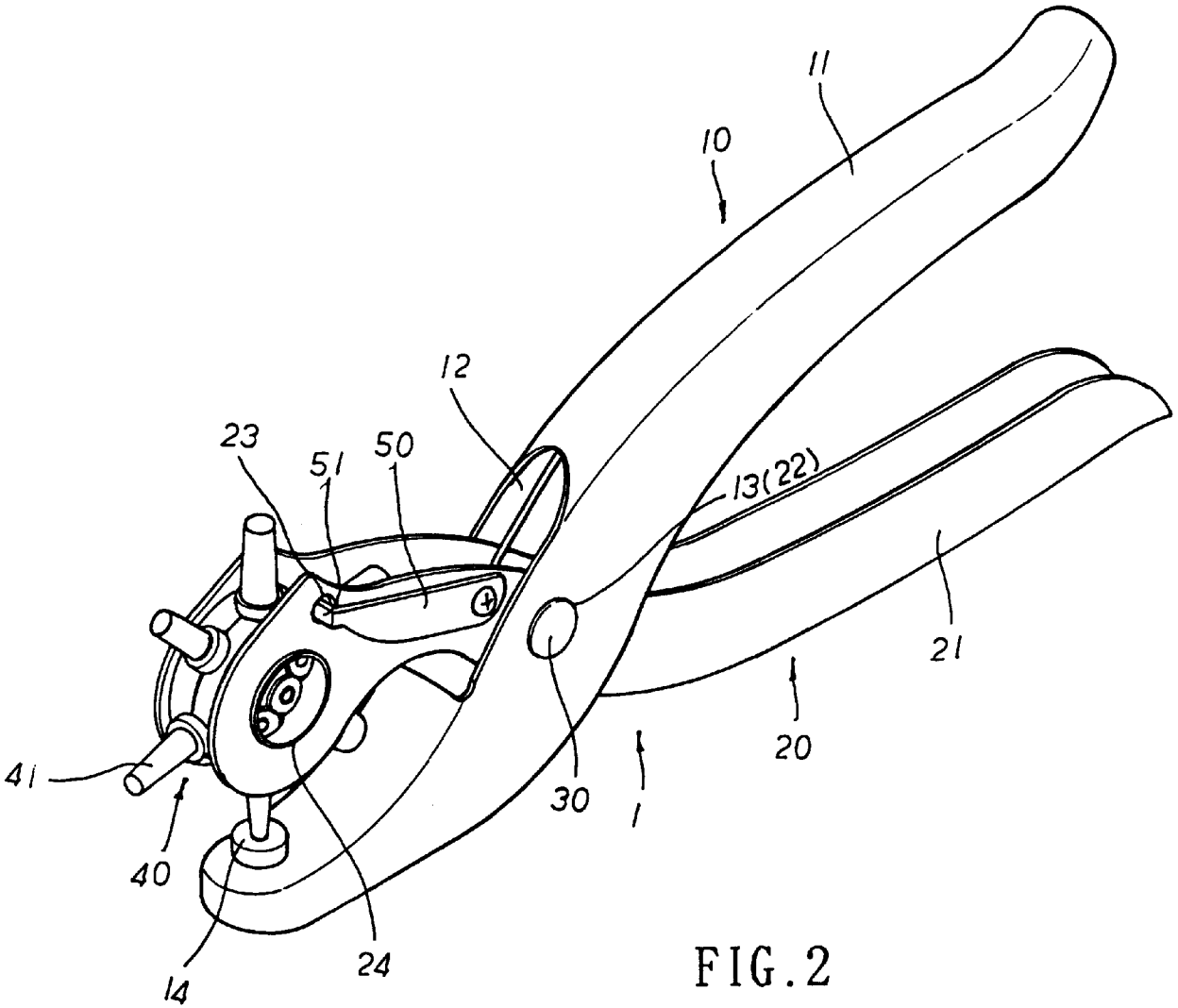
FIG. 2 PRIOR ART
FIG. 2 is another diagram showing the operation mode of the prior art illustrated in FIG. 1.
Figure 3:
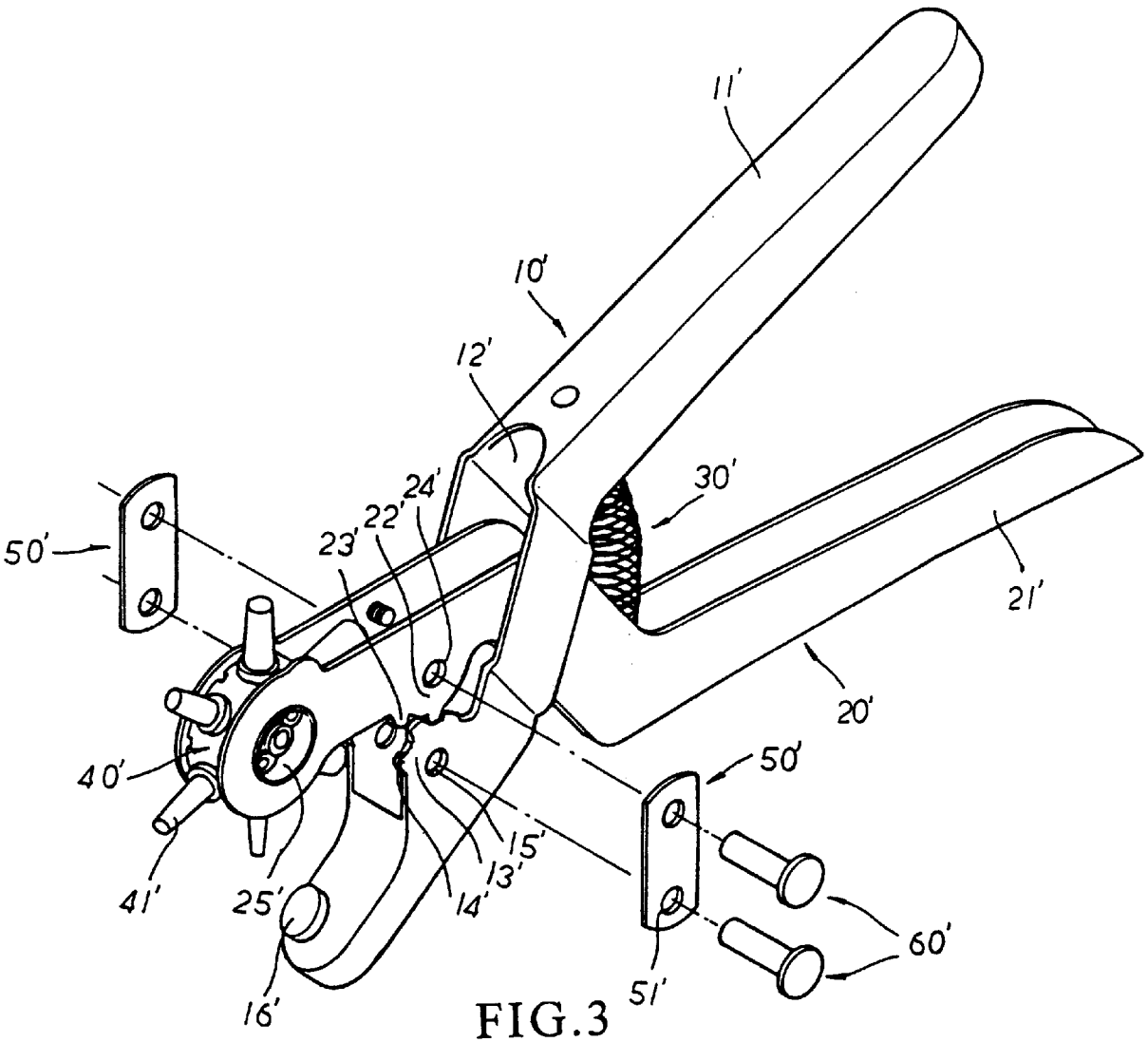
FIG. 3 is a perspective diagram showing some exploded components of the present invention.

Referring to FIG. 3, the improved hole-punching pliers 1' of the present invention is comprised of a holding part 10', a pressing part 20', a compression spring 30', a rotary hole-punching wheel 40', a pair of connection plates 50' and a pair of pin shafts 60'. The holding part 10' has a holding section 11' at the rear end and an opened insertion space 12'. At the front end of the holding part 10' which has two parallel side walls is disposed a curved engaging section 13' on each side wall. On the engaging section 13' are evenly spaced a plurality of mesh teeth 14'. In each engaging section 13' and adjacent the mesh teeth 14' is disposed a pin hole 15'. An anvil spot 16' with a proper height is placed at a frontmost mouth area of the holding part 10'. The pressing part 20' basically has the same shape as the holding part 10' but they are combined with each other in an upside-down manner.

The pressing part 20' has a pressing section 21' at a rear end thereof and has a pair of side walls at the front end thereof. On each side wall is disposed a curved engaging section 22' having a plurality of mesh teeth 23'. A pin hole 24' is placed in the engaging section 22' and right adjacent the mesh teeth 23'. On the other side, as shown in FIG. 4A, of the pliers is disposed a locking arm 26' for retaining the hole-punching wheel 40'.

At the frontmost end of the pressing part 20' is disposed a hollow space between its parallel side walls for housing a hole-punching wheel 40'. On each side wall is disposed a mounting hole 25' for rotary securing of the punching wheel 40' which is a round disc provided with a plurality of hole-punching rods 41' of different diameters on the periphery thereof and is mounted into the mounting holes 25' by way of a bearing.

Figure 4:
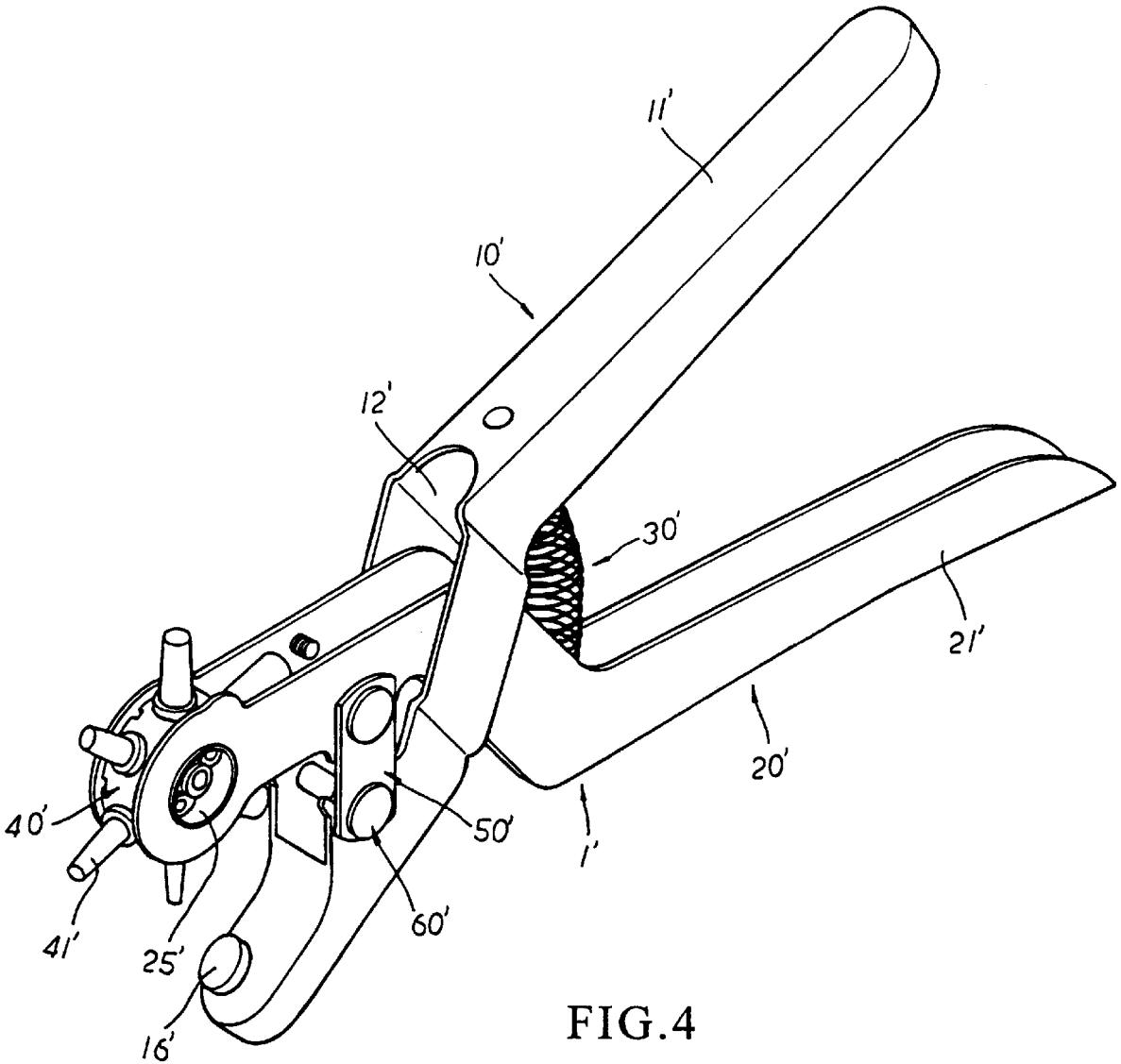
FIG. 4 is a diagram showing the hole-punching pliers of the present invention.
Figure 4A:
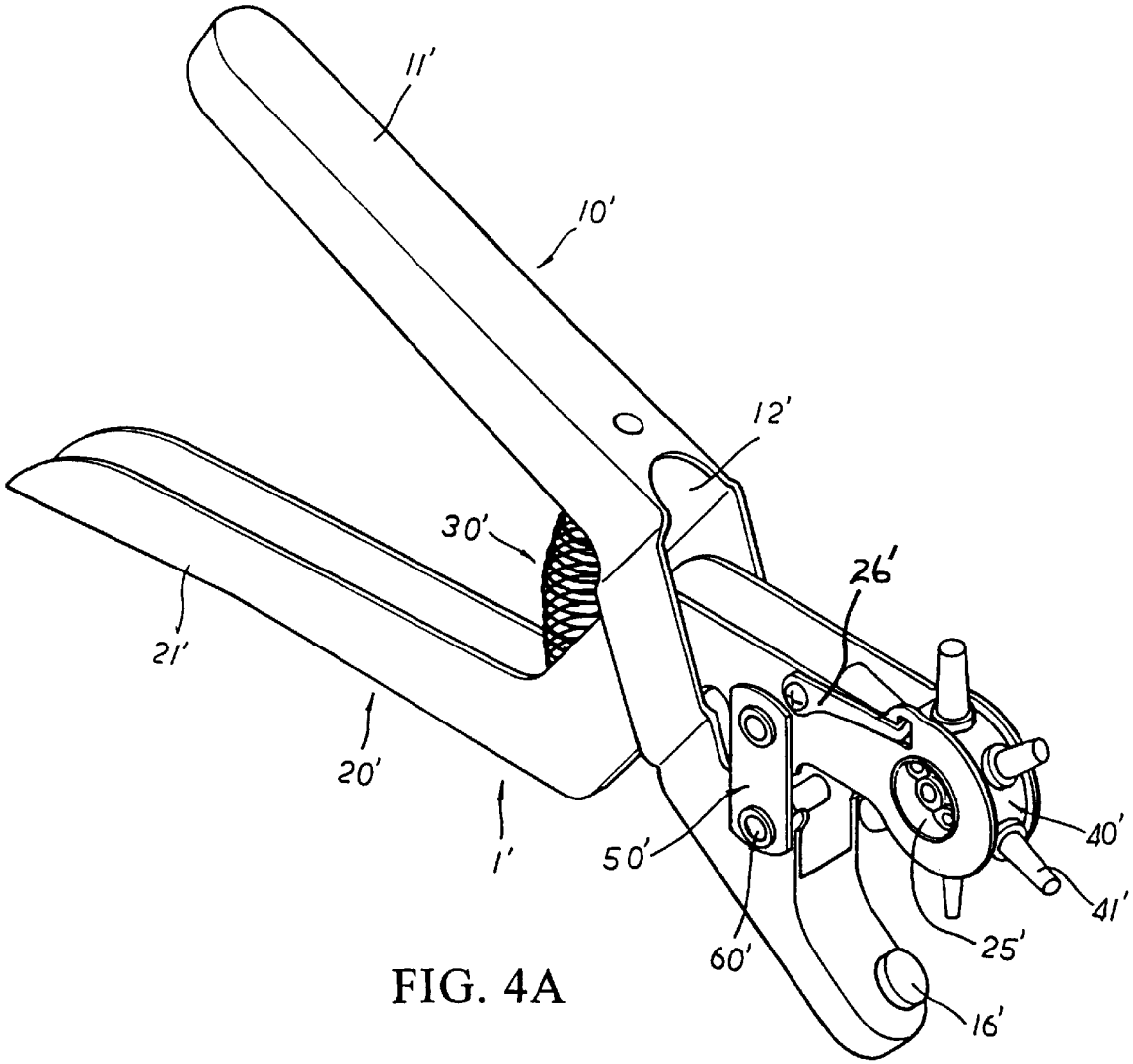
FIG. 4A is a diagram showing the other side of the hole-punching pliers.
Figure 5:
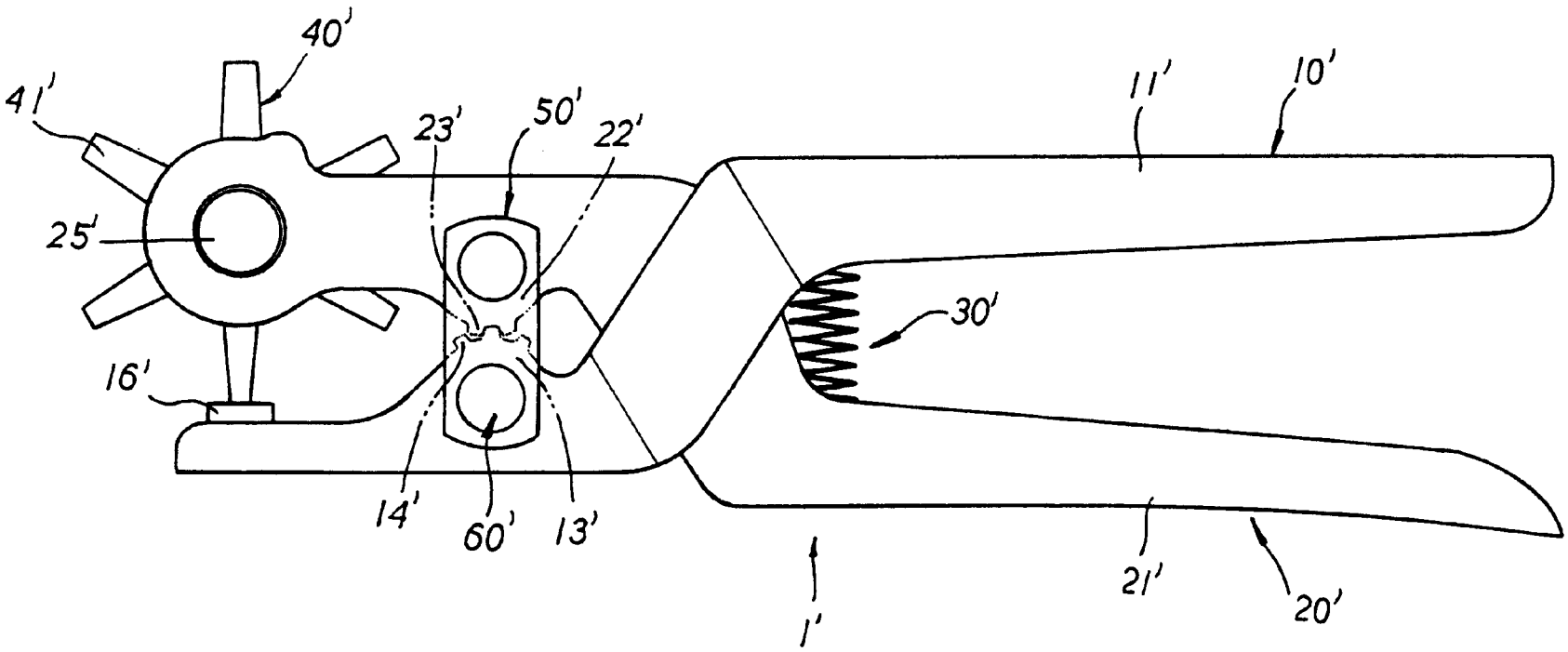
FIG. 5 is a diagram showing the operation mode thereof.

One of a pair of connection plates 50' each having a pair of through holes 51' is fixed to each side of the hole-punching pliers respectively, as shown in FIGS. 4, 4A.

In assembly, the pressing part 20' is first led through the hollow insertion space 12' of the holding part 10' and then the two parts are pivotally fixed together by the connection plates 50' which are secured in place by a pair of pin shafts 60' led through the through holes 51' of the plates 50' and the pin holes 15' and 24' respectively. At the same time, the mesh teeth 14' of the engaging section 13' of the holding part 10' and the mesh teeth 23' of the engaging section 22' of the pressing part 20' are partially in mesh. At last, the compression spring 30' is fixed placed between the holding part 10' and the pressing part 20' so as to permit the two parts retractably pivoted in operation.

In use, the hole-punching wheel 40' is rotated first to selectively locate a proper punching rod 41', then a piece or pieces of paper is placed between the punching rod 40' and the anvil spot 16'. When the holding section 11' and the pressing section 21' are pivoted toward each other, the pressing part 20' and the holding part 10' are pivoted about the pin shafts 60' of the connection plates 50' respectively with the meshed teeth 14', 23' served as a secondary fulcrum and in rotational mesh with each other as a result of the application of force applied to the holding section 10' and the pressing section 21'. Thereby, the punching rod 41' and the anvil spot 16' are moved toward each other for punching a hole of the same diameter % of on paper placed therebetween. Such a structure of the pliers 1' makes hole-punching easier and with less effort because a double lever effect can be produce by way of the connection plates and the engaged mesh teeth which serve as a secondary fulcrum.

Figure 6:
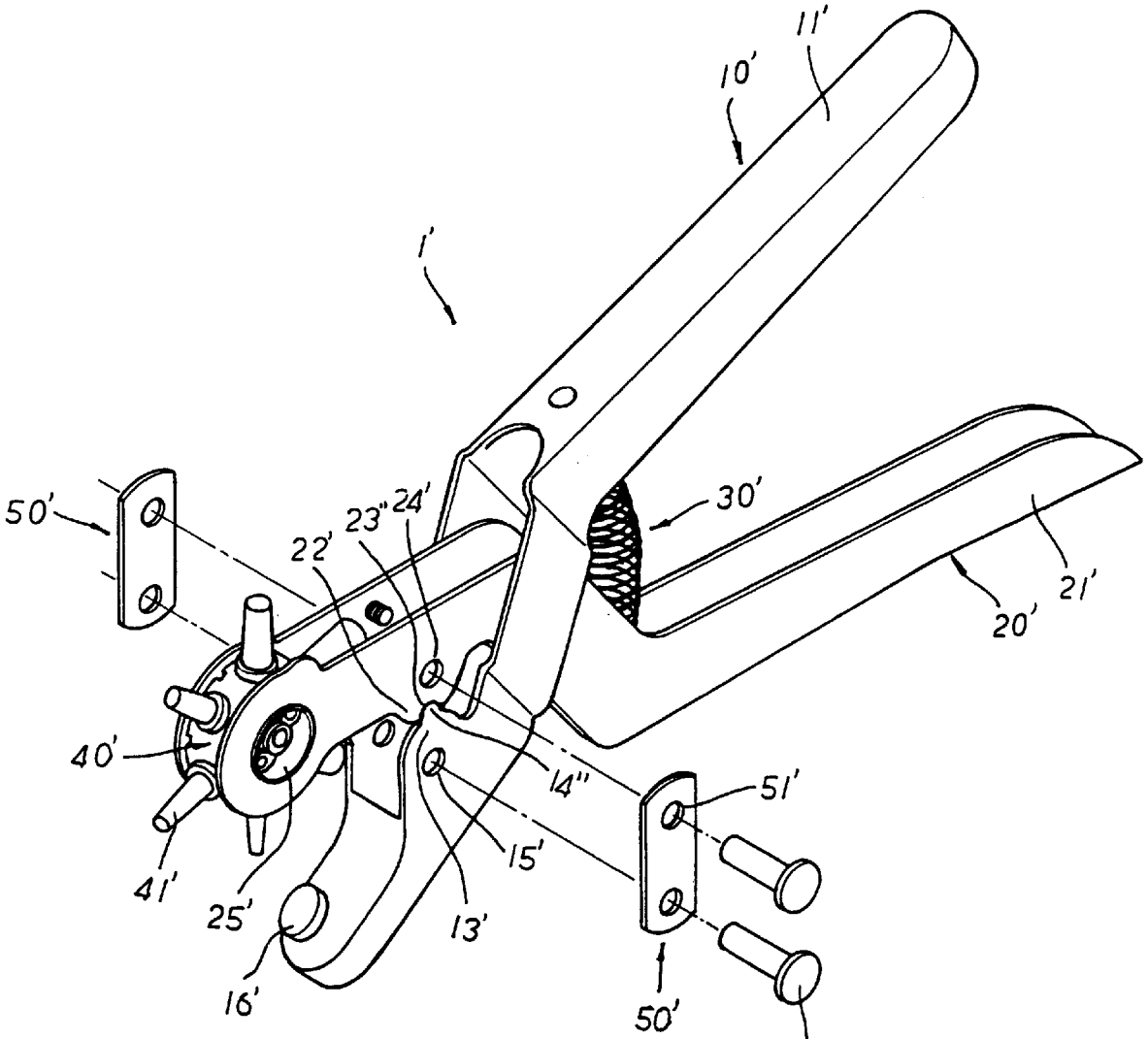
FIG. 6 is a diagram showing another embodiment of the present invention.

Referring to FIG. 6, another embodiment of the present hole-punching pliers is given wherein the mesh teeth 14', 23' of the engaging section 13', 22' of the first embodiment are replaced with a semi-circular protrusion 14" and a semi-circular recess 23". The second embodiment pliers is assembled in the same way as described in the first one, except with the semi-circular protrusion 14" engaged with the semi-circular recess 23". To form a secondary fulcrum. It can produce the same effective double lever result as the first embodiment in punching holes on a piece of paper.

Figure 7:
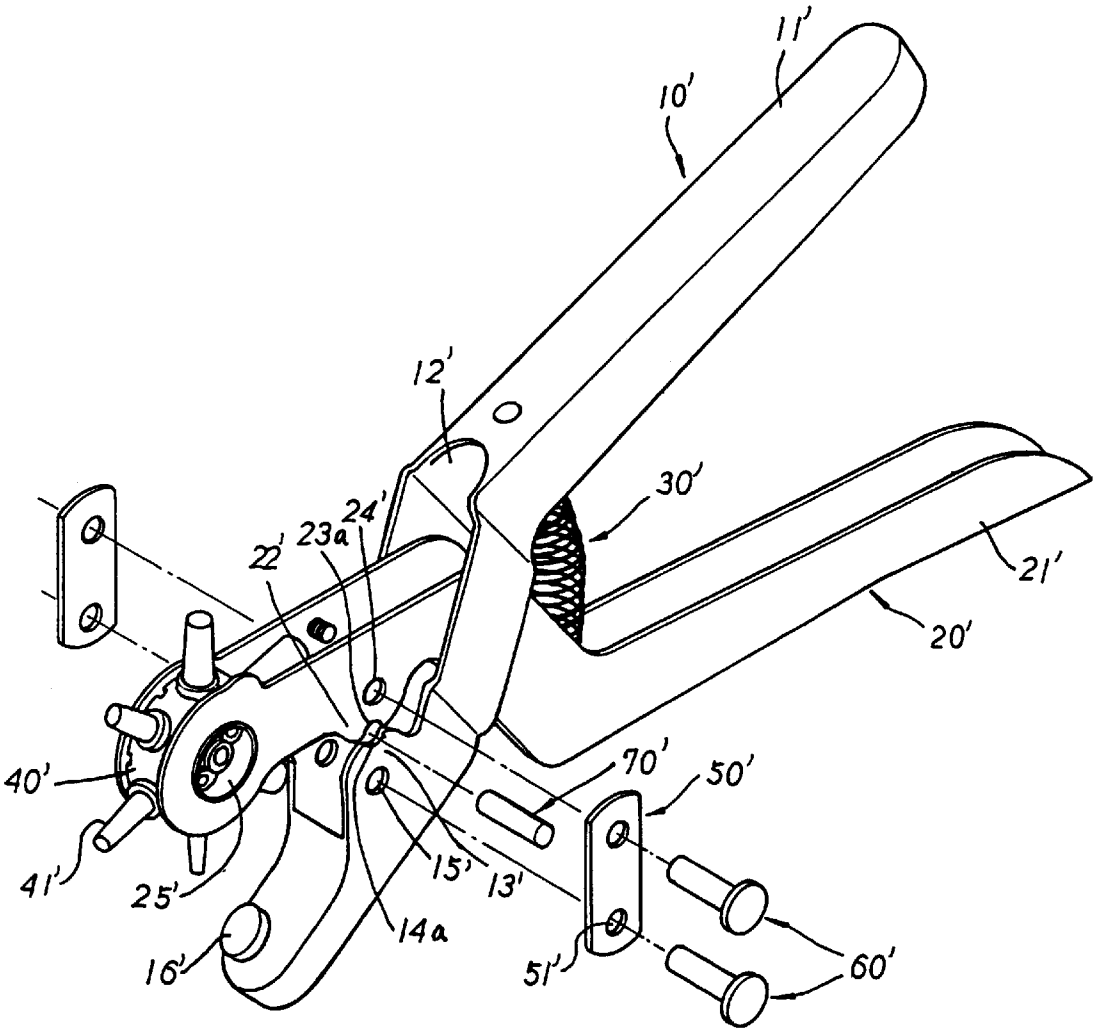
FIG. 7 is a diagram showing one further embodiment of the present invention.

Referring to FIG. 7, in the third embodiment, the mesh teeth 14', 23' of the engaging section 13', 22' of the first embodiment are replaced with a semi-circular recess 14*a* and a semi-circular recess 23*a* that are placed in alignment with each other to form a hole for receiving a shaft rod 70' therein. The assembly of the third embodiment pliers is carried out in the same way as that of the first and the second embodiment pliers except the additional shaft rod 70' which serves as a secondary fulcrum in use.

It can be clearly seen that in the present invention, the shift of the pivot shaft of a conventional hole-punching pliers toward the hole-punching wheel and the use of a secondary fulcrum, such as the mesh teeth 14', 23', or the shaft rod 70', or the semi-circular protrusion 14" engaged with the semi-circular recess 23", and the dual pin shafts 60', render an effective double lever result. Thereby 50% additional force can be produced at the hole-punching wheel and the anvil spot in a hole-punching operation.

I claim:

1. A hole-punching pliers comprising a holding part, a pressing part, a compression spring, a hole-punching wheel, a pair of connection plates and a pair of pin shafts wherein:

said holding part having an opened middle insertion space;

said pressing part led through said opened middle insertion space is pivotally engaged with said holding part;

said hole-punching wheel is rotatably secured to a front end of said pressing part;

a plurality of punching rods having various diameters are fixed to a peripheral surface of said hole-punching wheel for selectively punching differently sized holes;

said holding part has an anvil spot disposed at a front end thereof in such a manner that holes can be punched as a result of cooperation of said anvil spot and one selected punching rod of said hole-punching wheel;

the improvement is characterized in that:

said compression spring is disposed between said holding part and said pressing part so that said holding part and said pressing part can be retractably operated;

said holding part has a curved engaging section disposed next to said hole-punching wheel;

said pressing part has a curved engaging section disposed adjacent to said anvil spot;

in said engaging section of both said holding part and said pressing part is disposed a pin hole;

a fulcrum means is provided in said engaging section of both said holding part and said pressing part so that said holding part and said pressing part can be further supported in place at a secondary fulcrum defined by said fulcrum means;

said pair of connection plates are used to pivotally connect said holding part and said pressing part to each other by way of pin shafts led through said pin holes in said engaging sections of both said holding part and said pressing part;

said fulcrum means is fixedly located between said pin holes of both said holding part and said pressing part by said connection plates;

whereby a double lever effect can be produced by way of said fulcrum means and said connection plates to make a hole-punching task easier and with less effort.

2. The hole-punching pliers as claimed in claim 1 wherein said fulcrum means disposed in said engaging section of both holding part and said pressing part is made up of dentate mesh teeth that are partially in mesh in operation to serve as a secondary fulcrum.

3. The hole-punching pliers as claimed in claim 1 wherein said fulcrum means disposed in said engaging section of both holding part and said pressing part is made up of a semi-circular recess and a semi-circular protrusion that are engaged with each other in assembly to produce a secondary fulcrum.

4. The hole-punching pliers as claimed in claim 1 wherein said fulcrum means is made up of a shaft rod that is disposed in a hole defined by a semi-circular recess on said engaging section of said holding part and a semi-circular recess on said engaging section of said pressing part so as to form a secondary fulcrum.

* * * * *